US011230844B2

(12) United States Patent
Simonsen

(10) Patent No.: US 11,230,844 B2
(45) **Date of Patent: *Jan. 25, 2022**

(54) DOUBLE RETURN PANEL SYSTEM

(71) Applicant: Fairview Architectural, LLC, Bloomfield, CT (US)

(72) Inventor: David J. Simonsen, Redding, CA (US)

(73) Assignee: FAIRVIEW ARCHITECTURAL, LLC, Bloomfield, CT (US)

( * ) Notice: Subject to any disclaimer, the term of this patent is extended or adjusted under 35 U.S.C. 154(b) by 24 days.

This patent is subject to a terminal disclaimer.

(21) Appl. No.: 16/748,548

(22) Filed: Jan. 21, 2020

(65) Prior Publication Data

US 2021/0222438 A1 Jul. 22, 2021

Related U.S. Application Data

(63) Continuation of application No. 15/916,952, filed on Mar. 9, 2018, now Pat. No. 10,612,247.

(51) Int. Cl.
*E04F 13/08* (2006.01)

(52) U.S. Cl.
CPC ..... *E04F 13/0819* (2013.01); *E04F 13/083* (2013.01); *E04F 13/0821* (2013.01); *E04F 13/0891* (2013.01)

(58) Field of Classification Search
CPC . E04F 13/083; E04F 13/0889; E04F 13/0819; E04F 13/0821; E04F 13/0894; E04F 13/0898; E04F 13/0891
See application file for complete search history.

(56) References Cited

U.S. PATENT DOCUMENTS

| | | | | |
|---|---|---|---|---|
| 4,829,740 | A * | 5/1989 | Hutchison | E04B 2/90 52/475.1 |
| 5,809,729 | A | 9/1998 | Mitchell | |
| 6,035,598 | A * | 3/2000 | Sukolics | E04F 13/081 52/235 |
| 8,127,507 | B1 * | 3/2012 | Bilge | E04F 13/0823 52/235 |
| 9,328,517 | B2 * | 5/2016 | Bilge | E04F 13/0803 |
| 9,631,372 | B1 * | 4/2017 | Bilge | E04F 13/072 |
| 9,777,486 | B1 | 10/2017 | Simonsen | |
| 9,903,123 | B1 | 2/2018 | Simonsen | |
| 10,253,507 | B1 * | 4/2019 | Bilge | E04F 13/0807 |
| 2004/0123550 | A1 | 7/2004 | Hartman | |
| 2009/0145071 | A1 | 6/2009 | Radford | |
| 2009/0241451 | A1 | 10/2009 | Griffiths | |

(Continued)

FOREIGN PATENT DOCUMENTS

EP 0531869 A2 3/1993

OTHER PUBLICATIONS

International Search Report For Serial No. PCT/US18/56101 dated Feb. 8, 2019.

(Continued)

*Primary Examiner* — Christine T Cajilig
(74) *Attorney, Agent, or Firm* — McCormick, Paulding & Huber PLLC

(57) ABSTRACT

A double return panel system utilizing a perimeter extrusion having an arm terminating in an end portion configured to contact and twice bend a panel. The panel fits into a slot formed adjacent the arm. The perimeter extrusion is held to a facade by a base member.

18 Claims, 8 Drawing Sheets

(56) References Cited

U.S. PATENT DOCUMENTS

| | | | | |
|---|---|---|---|---|
| 2012/0017530 | A1* | 1/2012 | Hummel, III | E04F 13/081 52/506.05 |
| 2014/0202113 | A1* | 7/2014 | Bilge | E04F 13/0866 52/590.1 |
| 2015/0345152 | A1 | 12/2015 | Libreiro et al. | |
| 2016/0298338 | A1 | 10/2016 | Libreiro et al. | |

OTHER PUBLICATIONS

Extended European Search Report for corresponding EP Application No. 18908617.6 dated Oct. 28, 2021.

* cited by examiner

FIG. 9A
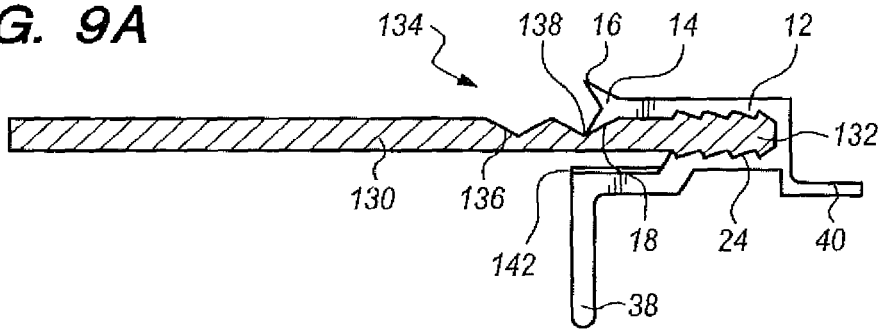
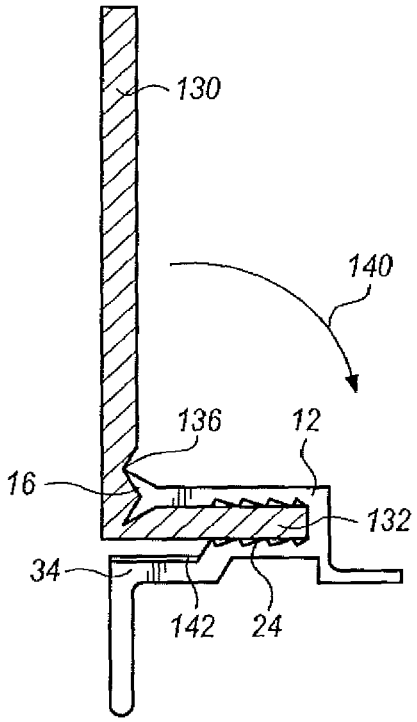
FIG. 9B

DOUBLE RETURN PANEL SYSTEM

CROSS-REFERENCES TO RELATED APPLICATIONS

The present application claims the benefit of Provisional Patent Application 62/469,698, filed 10 Mar. 2017 and Provisional Patent Application 62/071,473, filed 14 Mar. 2017.

The present application is a continuation of U.S. patent application Ser. No. 15/916,952m filed 9 Mar. 2018.

BACKGROUND OF THE INVENTION

The present application relates to a novel and useful double return panel system employed to clad or cover a facade.

In the past, many systems have been proposed to attach panels to a facade. For example, the systems found in U.S. Pat. Nos. 9,777,486 and 9,903,123 represent significant advances in the field of panel mounting systems.

In the construction arts, it is imperative that panel mounting systems allow for efficient installation and reduction in costs associated with materials and labor. It is also important that panel mounting systems be compatible with existing panel mounting apparatuses, while maintaining the advantages of moisture control, thermal contraction and expansion, and aesthetic appearance.

A panel mounting device or system which minimizes component parts and reduces the intensity of the labor required for installation would be a notable advance in the construction field.

SUMMARY OF THE INVENTION

In accordance with the present application, a novel and useful device for attaching panels to a facade is herein provided.

The device of the present application utilizes a support or perimeter extrusion that possesses an arm terminating in an end that is constructed to contact a panel and permit the bending of the same in two directions. Such device may be referred to as perimeter extrusion and does not require screws, rivets, structural tape, or adhesives, such as caulk, for assembling of the same with paneling material. Such perimeter extrusion panel is also ideally formed with a surface that possesses a removed portion formed by scoring or routing.

The perimeter extrusion also is fashioned with a platform that is contiguous with the arm and separates from the arm to form a slot. The slot is configured to capture a portion of the panel that has been bent by the arm end portion. Also, the slot may be formed by a wall having a serrated surface that permits positive gripping of a bent portion of the panel to fix the same in place.

It should be also noted that the end portion of the arm may include a prong or an enlargement that interacts with the removed portion of the panel to affect such bending and placement of a portion of the panel within the slot formed by the perimeter extrusion.

In addition, a leg that is contiguous with the platform extends outwardly from the platform.

A base is also included in the device of the present application and a first fastener holds the same to the facade. The leg of the perimeter extrusion lies closer to the base than to the platform.

The leg may also be formed with an aperture that accepts a second fastener in order to hold the leg to the base. Said base may take the form of a U-shaped member allowing spacing of adjacent perimeter extrusions and permitting thermal contraction and expansion of the panels in a predetermined direction.

In addition, the perimeter extrusion may also be provided with a shelf that is positioned outwardly from the slot but lies closer to the base than the slot. The shelf may be used to support a reveal strip used to occupy the space between adjacent perimeter extrusions supporting multiple panels.

Moreover, the perimeter extrusion may also be constructed with a flange that extends outwardly from the leg in opposition to the shelf. Such flange may be used to aid in the formation of a frame in which such flanges are placed in overlapping configuration for structural integrity. In addition, stiffeners may be employed within such frame in crisscross manner, with or without the use of mechanical fasteners. Such stiffeners also prevent the perimeter extrusions used therein to bend away from or disengage from the facade material. In certain configurations, the device of the present application may be employed to allow the placement of panels in overlapping rather than side-by-side configurations, either on a vertical or horizontal surface.

It may be apparent that a novel and useful device for the attaching of a panel or panels to a facade has been hereinabove described.

It is therefore an object of the present application to provide a device for attaching a panel to a facade that provides a double return panel system requiring a minimum of one extrusion to assemble a panel array without screws, rivets, structural tape, or caulk.

It is another object of the present application to provide a device for attaching a panel to a facade that requires a minimum amount of labor to install the same.

Another object of the present application is to provide a device for attaching a panel to facades of varying compositions.

Another object of the present application is to provide a device for attaching a panel to a facade resulting in a double return panel system employing a universal perimeter extrusion that can also be used as a stiffener extrusion.

Another object of the present application is to provide a device for attaching a panel to a facade that can be used on a vertical or horizontal orientation.

Another object of the present application is to provide a device for attaching a panel to a facade resulting in a double return panel system that utilizes cladding that may be formed of materials such as aluminum composite material (ACM), metal composite material (MCM), plate or sheet materials, insulated panels, and the like.

Another object of the present application is to provide a device for attaching a panel to a facade which is compatible with prior art mounting systems.

Another object of the present application is to provide a device for attaching a panel to a facade that accommodates the use of a reveal strip that is located immediately adjacent to a portion of a panel, allowing for minimal static friction effects, resulting in better thermal movement of the system.

Another object of the present application is to provide a device for attaching a panel to a facade that provides a double return panel system utilizing a clevis pin which can be used for both vertical and horizontal mounting.

Another object of the present application is to provide a device for attaching a panel to a facade that permits the use stiffeners without full length portions of tape or caulk.

Another object of the present application is to provide a device for attaching a panel to a facade that permits to assemblage if a frame through the interaction of perimeter extrusions having overlapping corners, saving time and materials in the installation of the same.

Another object of the present application is to provide a device for attaching a panel to a facade which may include a double return panel system having stiffeners that may be crisscrossed to provide strength to a frame formed from perimeter extrusions.

Another object of the present application is to provide a device for attaching a panel to a facade in which a perimeter extrusion acts as a folding tool to permit bending of the panel resulting in a double return panel system.

Another object of the present application is to provide a device for attaching a panel to a facade which anticipates the use of insulated materials held beneath the cladding elements, without fasteners or adhesives, preventing delamination of certain panels.

Another object of the present application is to provide a device for attaching a panel to a facade that results in a double return panel system that can be economically fabricated and installed and possesses increased aesthetics due to a shorter reveal depth between adjacent panels.

Another object of the present application is to provide a device for attaching a panel to a facade that facilitates the connection of a perimeter extrusion to a base member utilizing hook-and-pin style construction.

Another object of the present application is to provide a device for attaching a panel to a facade in which a perimeter extrusion includes a fishtail end portion which locks into a V-groove formed in the cladding material that eventually sandwiches the cladding material forming a double return panel system.

Another object of the present application is to provide a device for attaching a panel to a facade that uses a U-shaped base member mounted to the facade and where multiple perimeter extrusions are fastened to the U-shaped member that controls thermal expansion in a predetermined direction.

Another object of the present application is to provide a device for attaching a panel to a facade that possesses a U-shaped channel as a base member that includes indicia aiding the installer in proper positioning of fasteners utilized to connect the U-shaped member to the facade.

Another object of the present application is to provide a device for attaching a panel to a facade in which a perimeter extrusion provides a slot having teeth or serrations to hold a portion of the bent panel positively to the perimeter extrusion.

Yet another object of the present application is to provide a device for attaching a panel to a facade that utilizes a base member confining a perimeter extrusion supporting a panel into thermal contraction and expansion in a predetermined direction.

The invention possesses other objects and advantages especially as concerns particular characteristics and features thereof which will become apparent as the specification continues.

BRIEF DESCRIPTION OF THE SEVERAL VIEWS OF THE DRAWINGS

FIGS. 9A-9C illustrate the steps for installation of a panel in conjunction with the perimeter extrusion shown in FIG. 1.

Figure 1:
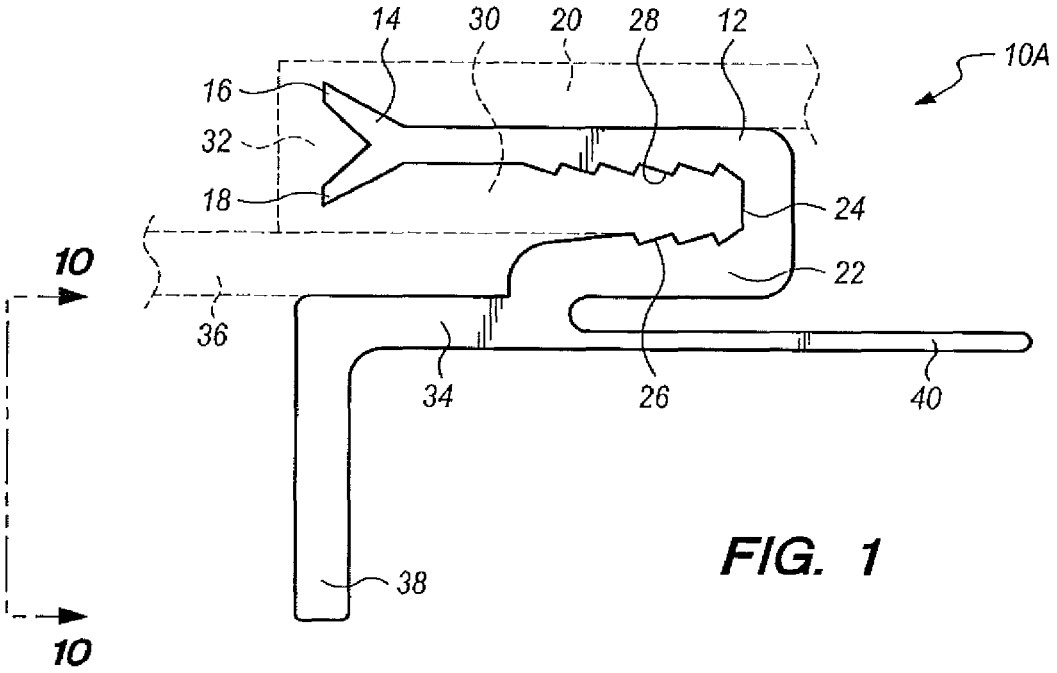
FIG. 1 is a side elevational view of an embodiment of a perimeter extrusion utilized in the device of the present application.

For a better understanding of the application, reference is made to the following detailed description of the preferred embodiments thereof which should be referenced to the prior described drawings.

DETAILED DESCRIPTION OF THE PREFERRED EMBODIMENTS

Various aspects of the present application will evolve from the following detailed description of the preferred embodiments which should be taken in conjunction with the prior delineated drawings.

The invention as a whole is shown in the drawings by reference character 10, with various embodiments denoted with the addition of an uppercase letter.

Referring now to FIG. 1, it may be observed that an embodiment 10A of a perimeter extrusion is shown in whole. Embodiment 10A includes an arm 12 terminating in an end portion 14. End portion is formed with prongs, fins, or tips 16 and 18, generally on the form of "fishtail". End portion 14 is employed to engage a panel 20, shown in phantom in FIGS. 1-8. Panel 20 includes removed portions to facilitate bending by end portion 14 of arm 12 of device 10A, which is best illustrated in FIG. 9A. Device 10A is also provided with a platform 22 which is contiguous with arm 12 and spaced therefrom to form a slot 24. Wall portion 26, surrounding slot 24, includes a serrated surface 28, which is used to grip part 30 of panel 20. It should also be noted that end part 32 of panel lies across end portion 14 of device 10, contacting prongs 16 and 18.

Figure 11:
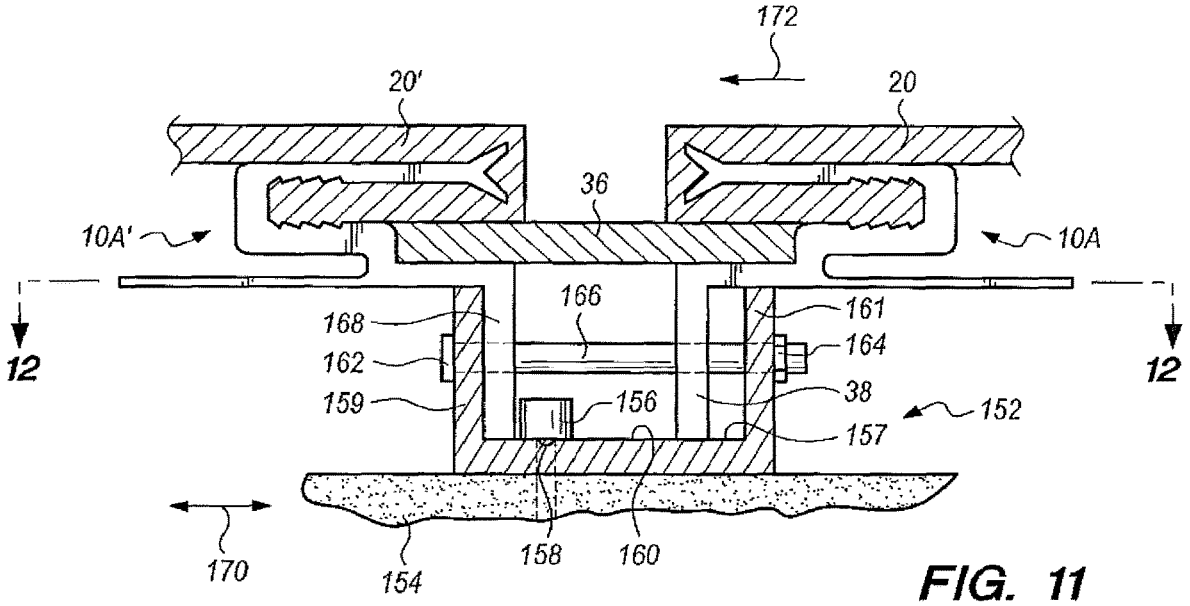
FIG. 11 is a side elevational view of a pair of perimeter extrusions shown in the embodiment of FIG. 1 with a pair of panels, a base member, and a reveal strip, shown in section.

Device 10 further possesses a shelf 34 which is intended to hold a reveal strip 36. Again, reveal strip 36 is shown in FIGS. 1-8 in phantom, and is best shown as a whole in FIG. 9C and FIG. 11. Device 10A is further constructed with a leg 38, which is intended to connect to the facade of the structure via a base member, which will be discussed hereinafter, and is best shown in FIG. 11. Flange 40 projects from device 10 in a direction opposite to shelf 34, the function of which will be discussed as the specification continues. It should be realized that arm 12, platform 22, shelf 34, leg 38, and flange 40 are contiguous in device 10A.

Figure 2:
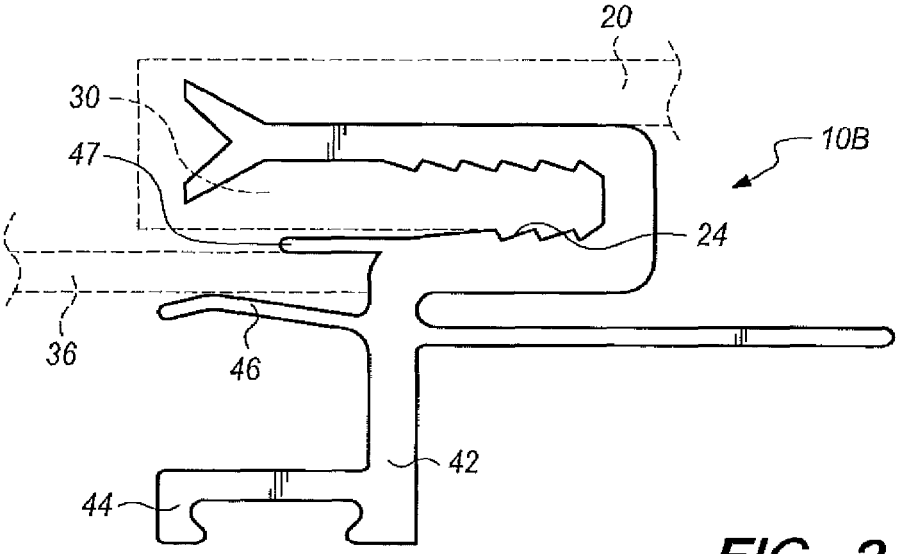
FIG. 2 is a side elevational view of another embodiment of a perimeter extrusion utilized in the present application.

Turning now to FIG. 2, embodiment 10B of the perimeter extrusion is depicted. Device 10B is similar to device 10A except that leg 42 includes an end portion 44, which is compatible with prior art fixation mechanisms used to attach embodiment 10B to a facade. For example, end portion 44 may be employed with the fixation mechanism shown in U.S. Pat. No. 9,903,123, which is incorporated by reference as a whole. Also, a shelf 46 is included which extends from embodiment 10B and is slightly tilted upwardly to provide support for reveal strip 36 against end part 30 of panel 20. In addition, a spacer 47 extends from slot 24 to maintain frictional engagement between panel 20 and reveal 36.

Figure 3:
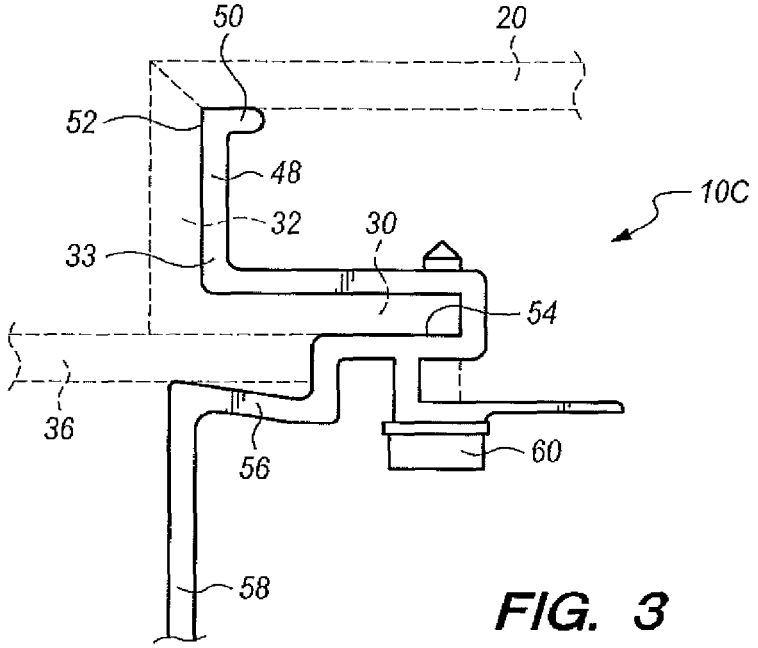
FIG. 3 is a side elevational view of another embodiment of a perimeter extrusion utilized in the present application.

FIG. 3 reveals another embodiment 10C of the device of the present application in the form of a perimeter extrusion in which an arm 48 includes an end portion 50 having a corner 52 that, again, allows for the easy bending of panel 20. Elbow 33 also serves to further bend panel 20 to form end part 30. Again, end part 30 of panel 20 lies in a slot 54 and a shelf 56 supports reveal strip 36. Leg 58 is similar to leg 38 of FIG. 1. A fastener 60 is shown as being an option to hold end part 30 of panel 20 within slot 54.

Figure 4:
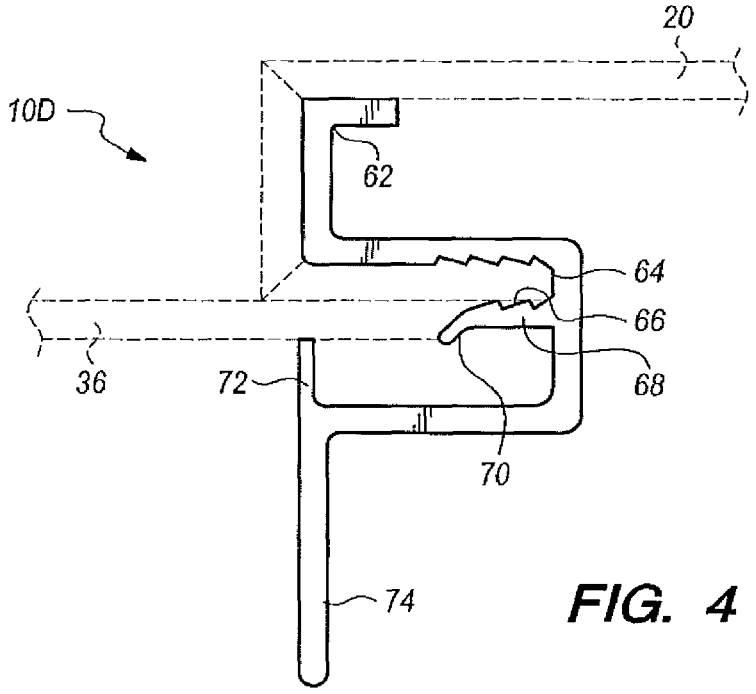
FIG. 4 is a side elevational view of another embodiment of a perimeter extrusion utilized in the present application.

FIG. 4 shows another embodiment 10D of a perimeter extrusion of the device of the present application. Embodiment 10D possesses an end portion 62, which is similar to end portion 48 of embodiment 10C of FIG. 3. Slot 64 includes a serrated surface 66 and a wall 68 having a turned end 70. Wall 72 extends outwardly from leg 74 and holds reveal strip in place with turned end 70 of wall 68.

Figure 5:
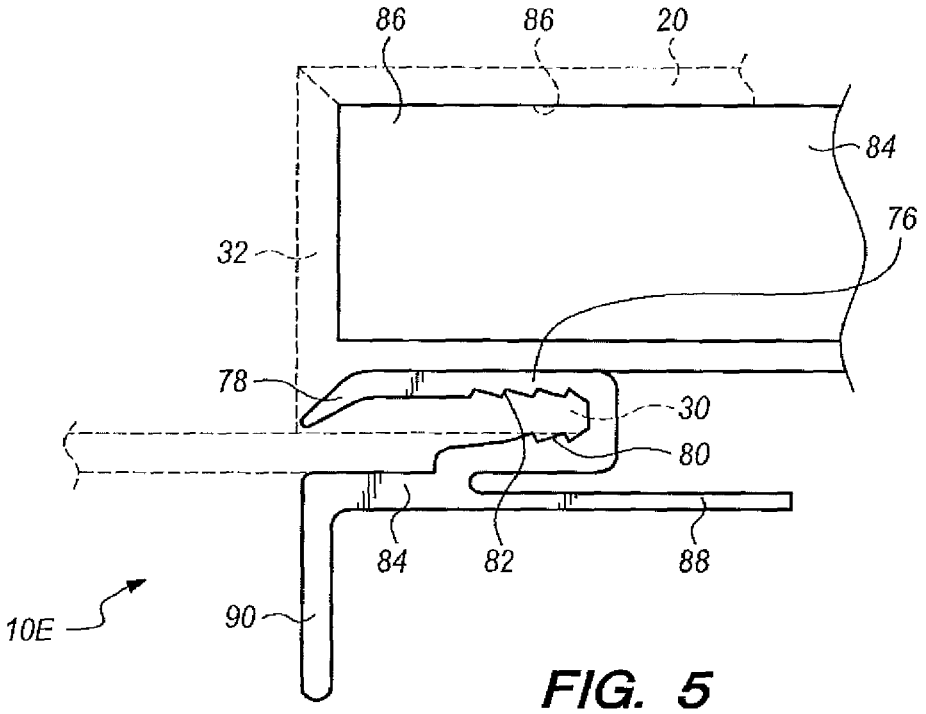
FIG. 5 is a side elevational view of a perimeter extrusion utilized in the present application with an insulated member.

FIG. 5 illustrates another embodiment 10E of the perimeter extrusion of the device of the present application in which a leg 76 terminates in a prong 78 that allows the bending and forming of portions 30 and 32 of panel 20. Portion 30 fits within slot 80 having a serrated surface 82. An insulated element 84 lies adjacent part 32 of panel 20 and under surface 86 of panel 20. Corner 86 of insulated element 84 aids in the bending of panel 20, although a second prong similar to prong 78 may be extended upwardly to substitute for corner 86 of insulated element 84. Flange 88 projects outwardly from shelf 84. Leg 90, similar to leg 74, FIG. 4, extends downwardly for connection to a base member, to be described hereinafter.

Figure 6:
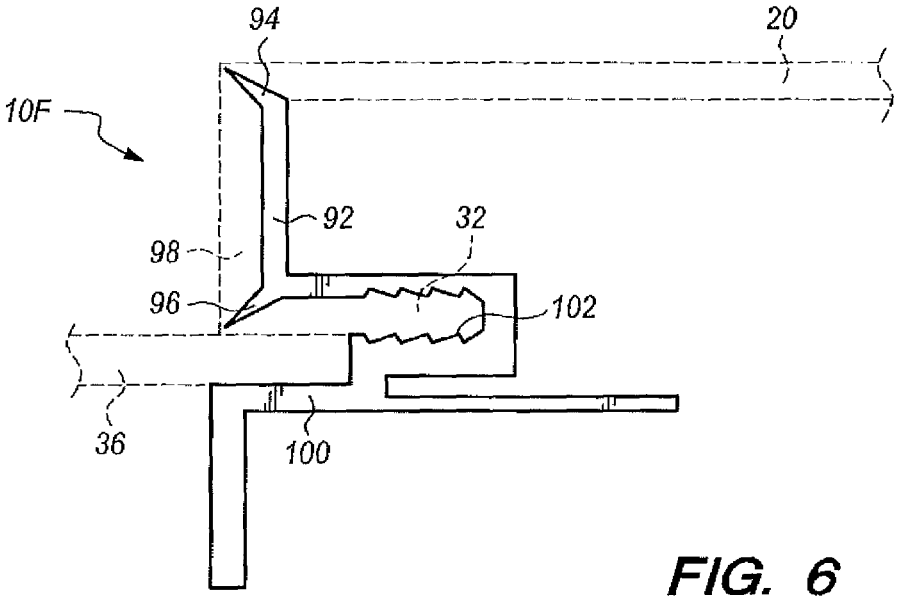
FIG. 6 is a side elevational view of another embodiment of a perimeter extrusion utilized in the present application.

Viewing now FIG. 6, another embodiment 10F of the perimeter extrusion of the device of the present application is shown. Device 10F shows a leg 92. Leg 92 includes prongs or fins 94 and 96, which are spaced apart from each other a greater distance than the prongs depicted in FIG. 1 with respect to embodiment 10A. Thus, panel section 98 is formed creating a greater depth for the placement of reveal strip 36 on shelf 100. Slot 102 takes a form similar to slot 80 of FIG. 5.

Figure 7:
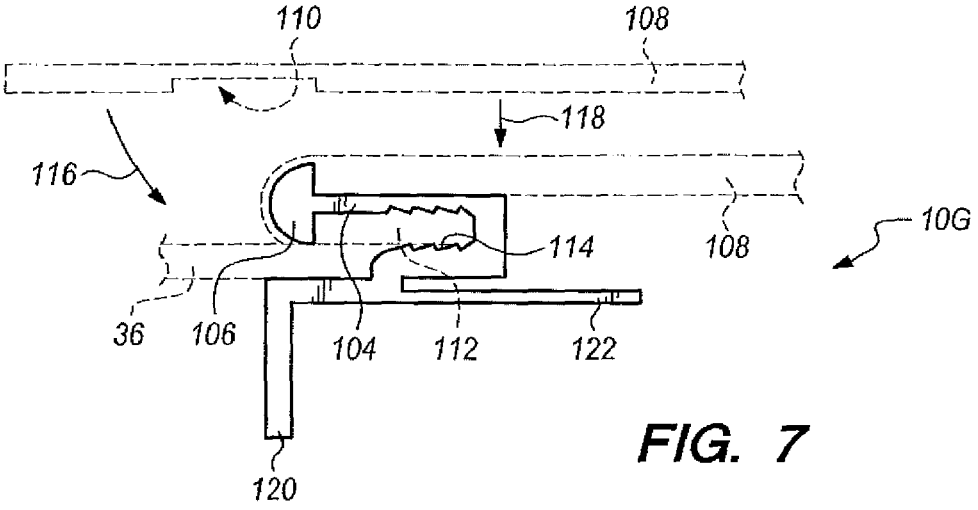
FIG. 7 is a side elevational view of another embodiment of a perimeter extrusion utilized in the present application.

FIG. 7 reveals another embodiment 10G of the perimeter extrusion of the device of the present application in which arm 104 possesses an end portion 106 which is approximately hemispherical. Panel 108 is formed with a removed or relieved portion 110, which is created by any suitable mechanical tool, such as a router. Panel 108 is then bent around end portion 106 to create an end part 114 that fits within slot 112. Directional arrow 116 indicates such bending action while directional arrow 118 shows the downward positioning of panel 108 around leg 104. Leg 120 and flange 122 are similar in structure to such elements shown in FIG. 1 with respect to embodiment 10A.

Figure 8:
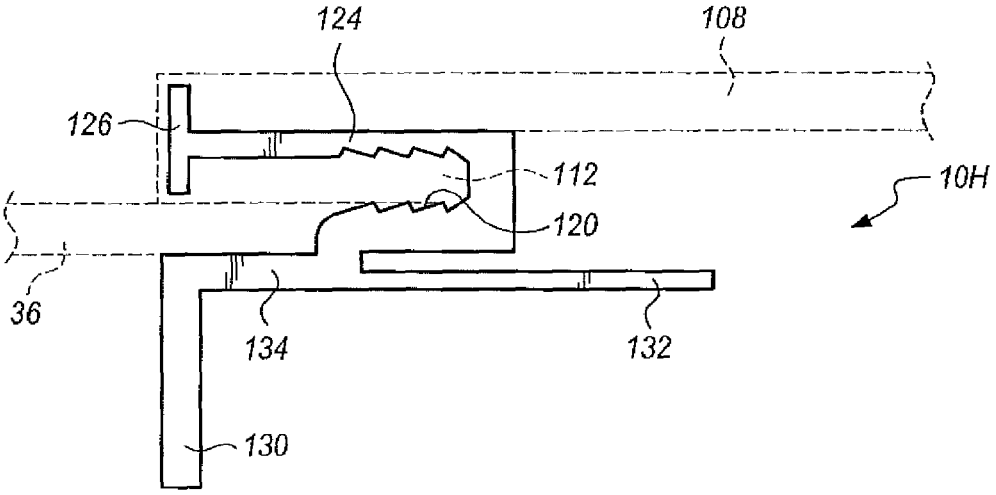
FIG. 8 is a side elevational view of another embodiment of a perimeter extrusion utilized in the present application.

Looking at FIG. 8, another embodiment 10H of the perimeter extrusion of the device of the present application is depicted. Device 10H is made with an arm 124 and is used in conjunction with panel 108 of FIG. 7. End portion 126 of arm 124 is approximately T-shaped and allows the bending of panel 108 around arm 124 such that panel and part 112 fits within slot 128.

Figure 9C:
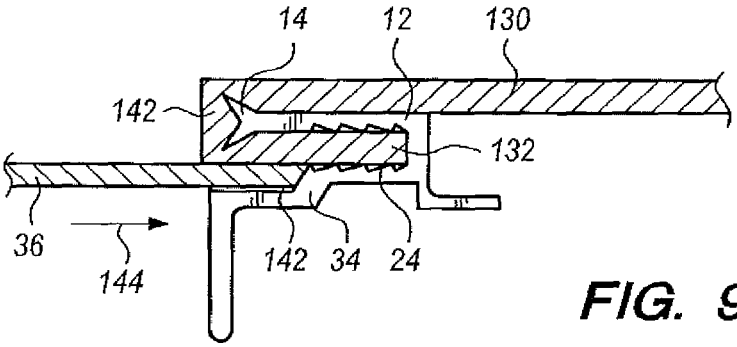

FIGS. 9A-9C delineate the steps involved in the operation of the bending and securing of a panel 130 causing a perimeter extrusion similar to the extrusion depicted as embodiment 10A of FIG. 1. Consequently, the elements of the extrusion shown in FIGS. 9A-9C will bear the same reference characters shown in FIG. 1. Panel 130 is formed with an end part 132 which lies adjacent to a relieved or removed portion 134. Removed portion 134 possesses crevices 136 and 138. Initially, end part 132 of panel 130 is placed in slot 124 such that crevice 138 bears against prong 18 of end portion 14 of arm 12, FIG. 9A. FIG. 9B shows the turning, bending, or folding of panel 130 such that channel 136 contacts prong 16 of arm 12. Directional arrow 140 indicates the turning, bending, or folding movement of panel 130. FIG. 9C shows panel 130 in its finished condition after panel 130 has been folded via prong 16 in crevice 136, such that panel part 132 lies within slot 24 and panel part 142 lies against prong end portion 14 of arm 12. Thus, perimeter extrusion 10A serves as a folding tool that remains adjacent panel 130 after employment. It should be noted that an optional double sided tape layer 142 is pictured as lying atop shelf 34, FIGS. 9B and 9C, in order to rest against reveal strip 36 placed on shelf 34, according to directional arrow 144, FIG. 9C. Also, double-sided tape or caulk may be inserted between arm 12 and the underside op panel 130 to stabilize movement therebetween.

Figure 10:
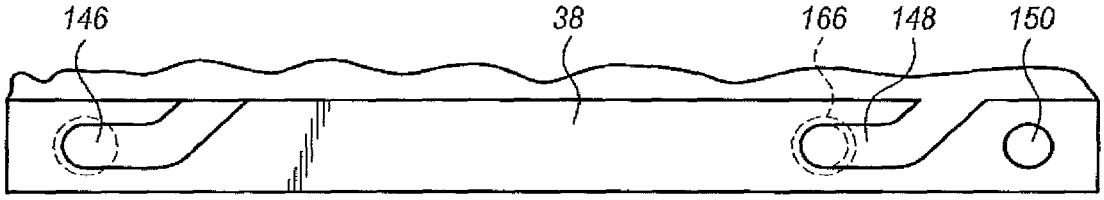
FIG. 10 is a side elevational view of a portion of the perimeter extrusion taken along line 10-10 of FIG. 1.
Figure 12:
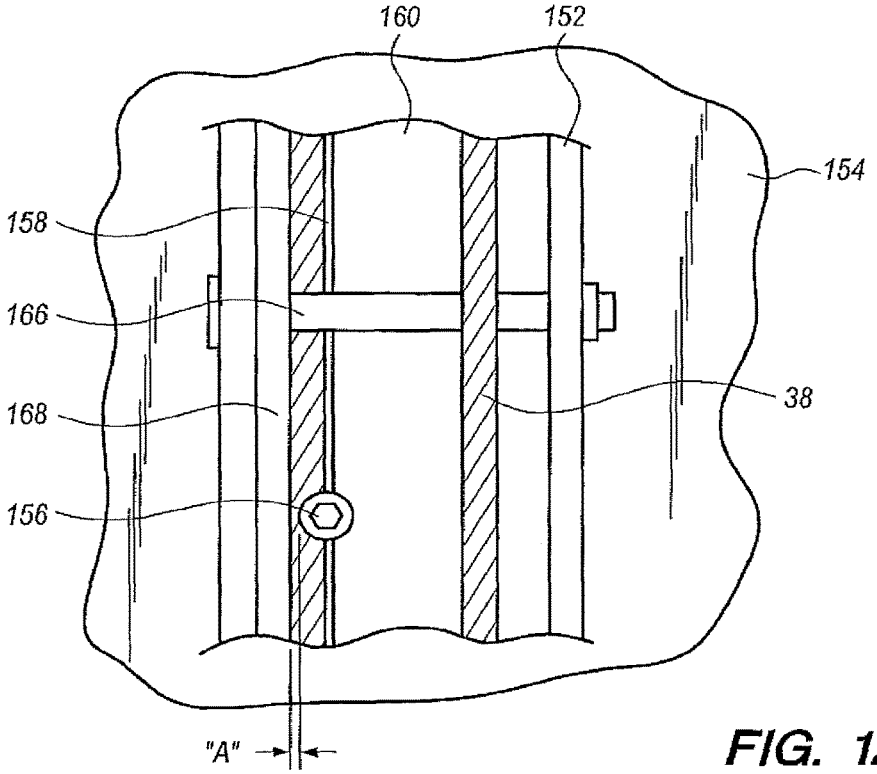
FIG. 12 is a partial tap plan view of the illustration depicted in FIG. 11.

FIG. 10 illustrates the side portion of leg 38 of embodiment 10A of FIG. 1 and other legs of embodiments 10B-10H that are similar in FIGS. 2-8. Apertures 146 and 148 are shown as well as opening 150 therethrough. Apertures 146 and 148 as well as opening 150 are intended to interact with base 152 shown in FIGS. 11 and 12. Base or channel 152 is held to facade 154 by a positioning fastener 156. Base 152 includes bottom surface 157 and extending walls 159 and 161. A locating groove 158 in surface 157 aids in the placement of fastener 156 at the base 160 of channel 152. Grooves 162 and 164 along walls 159 and 161, respectively, aid in marking the placement of clevis pin 166, which extends through a drilled hole (not shown) through base 152. Clevis pin 166 is exemplary of a multiplicity of clevis pins which may be used along channel 152. It should be noted that the apertures 146 and 148 of FIG. 10 of leg 38 are intended to interact with clevis pin 166 as well as others used therein. It should also be realized that the placement of fastener 156 forms a gap "A", FIG. 12, between leg 38 and channel 152. Thus, leg 168 of device 10$A^1$ is fixed such that the thermal expansion and contraction of panel 20$^1$ is confined to directions along arrow 170, since leg 168 is held between channel 152 and positioning fastener 156. In other words, fastener 156 prevents movement of leg 168 outside gap "A". Of course, other positioning fasteners may be used along groove 158 to maintain this confinement of extrusion panel 10$A^1$. The same holds true for other panels used in the system depicted in FIGS. 11 and 12, including, panel 20, which is held to a similar channel to channel 52 (not shown) and is thus allowed to expand according to directional arrow 172.

Figure 13:
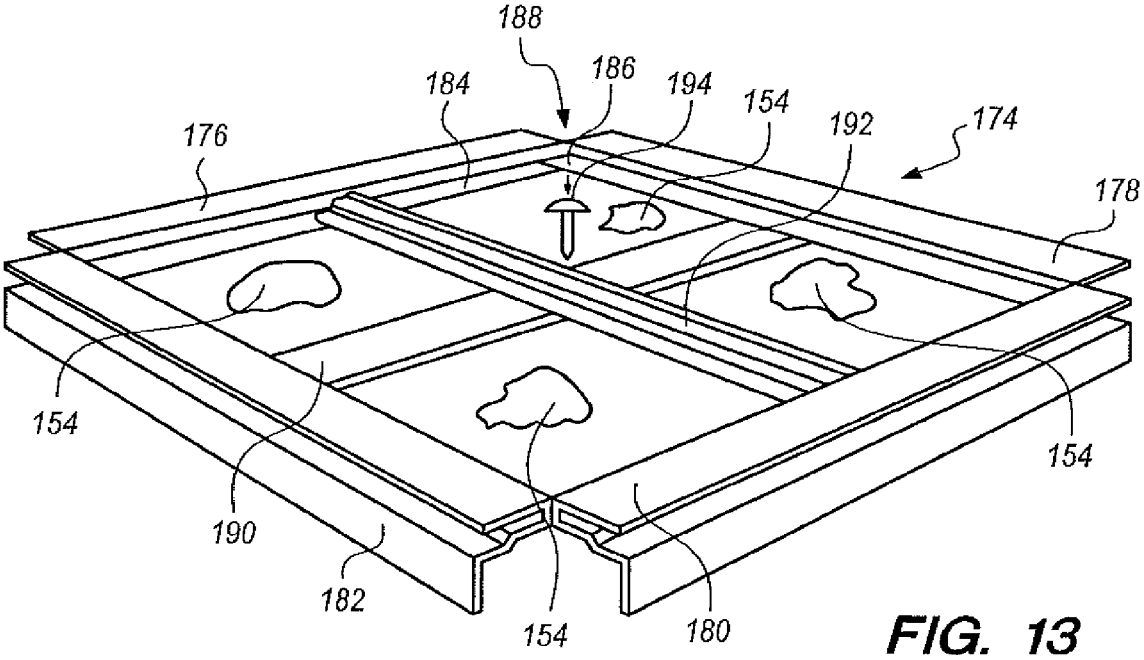
FIG. 13 is a right side front top perspective view of a quartet of perimeter extrusions forming a frame.

A frame 174 may be formed with perimeter extrusions 176, 178, 180, and 182, FIG. 13. Each perimeter extrusion, as shown in FIG. 13, is similar to the embodiment depicted as 10A in FIG. 1. It should be also seen that flanges 184 of perimeter extrusions 176 and 178 overlap each other at the corner 188 of frame 174. Fasteners may be used at such overlay location to hold perimeter extrusions 176 and 178 together (not shown). Such flanges correspond to flange 40 of FIG. 1. Perimeter extrusions 176, 178, 180, and 182 are also depicted without attached panels and apertured side portions of legs for the sake of simplicity. Stiffeners 190 and 192 may also be used with frame 174 and are positioned flat side-to-flat side thereat. An optional fastener 194, may also be employed to fix stiffeners 190 and 192 to each other and to facade 154. Also, fasteners may be employed to hold stiffeners to perimeter extrusions 176, 178, 180, and 182. Exemplar flange 184 of perimeter extrusion 176 may be used for this purpose.

Figure 14:
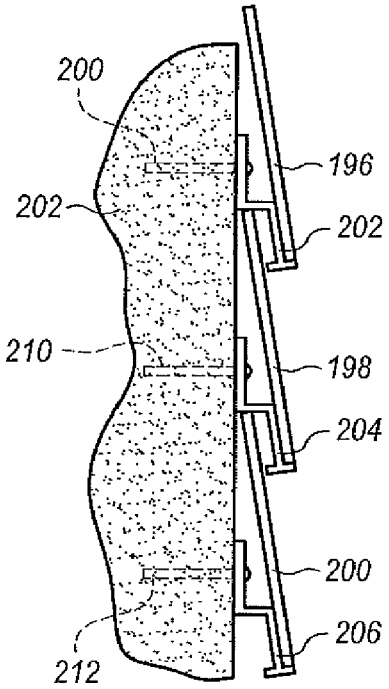
FIG. 14 is a side elevational view of a multiplicity of perimeter extrusions mounting a panel system on a vertical facade.

Turning to FIG. 14, it may be observed that panels 196, 198, and 200 are positioned in overlapping configuration along a vertical facade 202. Perimeter extrusions 202, 204, and 206 support panels 196, 198, and 200 in this position, and are held to facade 202 by fasteners 208, 210, and 212.

In operation, any one of the perimeter extrusions 10A-10H of FIGS. 1-8 may be employed with properly routed panels such as panel 20. With reference to FIGS. 9A-9C, it may be observed that a panel 130, similar to panel 120, is used and fits within slot 24. Crevice 138 of panel 130 also bears against prong 18 of end portion 14 of arm 12 of embodiment 10A. Panel 130 is then raised upwardly to effect the first bend such that prong 16 contacts crevice 136 and then is further bent such that the remainder of panel 130 lies atop arm 12 when panel 130 is bent over prong 16. Reveal 36 is then slipped below portion 132 of panel 130 on shelf 134. Double sided tape 142 may be optionally used to further fix panel 130 in place. Once assembled, perimeter extrusions 10A-10H firmly hold any panels, such as panel 20, in place at facade 154.

While in the foregoing embodiments of the application have been set forth in considerable detail for the purposes of making a complete disclosure of the application, it may be apparent to those of skill in the art that numerous changes may be mad in such details without departing from the spirit and principles of the application.

What is claimed is:

1. A device for attaching a panel to a facade, comprising an extrusion having:

an arm, said arm terminating in an end portion, said end portion comprising at least one prong for contacting said panel and permitting the bending of the panel about said at least one prong;

a platform, said platform being contiguous with said arm and extending from said arm, said platform further being spaced from said arm for forming a slot, said slot being configured to capture a portion of the panel;

a leg, said leg being contiguous with said platform and extending outwardly therefrom;

a base, said leg lying closer to said base than to said platform;

a first fastener for holding said base to the facade;

a second fastener for holding said leg to said base; and an aperture extending through said leg, said second fastener extending through said aperture.

2. A device for forming a covering on a facade, comprising:

a panel;

an extrusion having an arm, said arm terminating in an end portion, said end portion comprising at least one prong for contacting said panel and permitting the bending of the panel about said at least one prong;

a platform, said platform being contiguous with said arm and extending from said arm, said platform further being spaced from said arm for forming a slot, said slot being configured to capture a portion of the panel;

a leg, said leg being contiguous with said platform and extending outwardly therefrom;

a base, said leg lying closer to said base than to said platform;

a first fastener for holding said base to the facade; and a second fastener for holding said leg to said base;

said base comprising a surface, said surface including a marking for locating said first fastener.

3. The device of claim 2 in which said base including a surface further includes a base wall extending from said surface and said first fastener forms a gap between said first fastener and said base wall, said gap being sized to confine movement of said leg of said extrusion within said gap.

4. The device of claim 2 in which said panel possesses a removed portion.

5. The device of claim 2 which additionally comprises an insulation member supported on said arm.

6. A method of forming a covering on a facade utilizing the steps of:

providing a panel, said panel having a surface possessing a removed portion;

providing an arm supported by said facade, said arm terminating in an end portion comprising at least one prong for contacting said panel removed portion;

bending said panel over said at least one prong of said arm end portion;

holding said panel adjacent said arm while the panel is bent over said at least one prong; and again bending said panel over said arm following said step of bending said panel over said at least one prong of said arm portion.

7. The method according to claim 6, wherein the step of bending said panel over said at least one prong of said arm end portion includes positioning said at least one prong of said arm end portion within said removed portion of the surface of the panel.

8. The method according to claim 6, wherein the surface of the panel possesses a first removed portion and a second removed portion; and wherein said end portion of said arm comprises a first prong for contacting said first panel removed portion and a second prong for contacting said second panel removed portion.

9. The method according to claim 8, wherein the step of bending said panel over said at least one prong of said arm end portion includes positioning said first prong of said arm end portion within said first panel removed portion; and wherein the step of again bending said panel over said arm includes positioning said second prong of said arm end portion within said second panel removed portion.

10. The device according to claim 1, wherein said end portion comprises two prongs for contacting said panel and permitting the bending of the panel about said two prongs.

11. The device for forming a covering on a facade according to claim 2, wherein said end portion of said arm comprises two prongs for contacting said panel and permitting the bending of the panel about said two prongs.

12. The device according to claim 11, wherein the panel has a first removed portion and a second removed portion.

13. The device according to claim 12, wherein the first removed portion is configured to interact with a first prong of the two prongs during bending of the panel and the second removed portion is configured to interact with a second prong of the two prongs during bending of the panel.

14. The device according to claim 2, wherein the marking for locating said first fastener comprises a groove.

15. A device for attaching a panel to a facade, the device comprising:

an extrusion including:

an arm, said arm terminating in an end portion comprising at least one prong for contacting said panel and permitting bending of the panel about said at least one prong;

a platform extending from said arm, said platform being spaced from said arm to form a slot, said slot being configured to capture a portion of the panel; and a leg extending outwardly from said platform and including an aperture extending through said leg; and a base configured to be secured to the facade by a first fastener;

wherein the leg is configured to be held on said base by a second fastener extending through said aperture.

16. The device according to claim 15, wherein said end portion comprises two prongs for contacting said panel and permitting the bending of the panel about said two prongs.

17. The device according to claim 15, wherein the base comprises a surface, said surface including a marking for locating said first fastener.

18. The device according to claim 17, wherein the marking comprises a groove.

* * * * *